US011578503B2

(12) United States Patent
Wardi

(10) Patent No.: US 11,578,503 B2
(45) Date of Patent: Feb. 14, 2023

(54) CLOSURE HOLDER FOR A DOOR CLOSURE

(71) Applicant: EMKA BESCHLAGTEILE GMBH & CO. KG, Velbert (DE)

(72) Inventor: Florian Wardi, Wuppertal (DE)

(73) Assignee: EMKA Beschlagteile GmbH & Co. KG, Velbert (DE)

( * ) Notice: Subject to any disclaimer, the term of this patent is extended or adjusted under 35 U.S.C. 154(b) by 109 days.

(21) Appl. No.: 16/970,471

(22) PCT Filed: Feb. 20, 2019

(86) PCT No.: PCT/DE2019/100163
§ 371 (c)(1),
(2) Date: Aug. 17, 2020

(87) PCT Pub. No.: WO2019/161847
PCT Pub. Date: Aug. 29, 2019

(65) Prior Publication Data

US 2021/0115700 A1 Apr. 22, 2021

(30) Foreign Application Priority Data

Feb. 20, 2018 (DE) ..... 10 2018 103 737.6

(51) Int. Cl.
*E05B 15/02* (2006.01)

(52) U.S. Cl.
CPC ..... *E05B 15/025* (2013.01)

(58) Field of Classification Search
None
See application file for complete search history.

(56) References Cited

U.S. PATENT DOCUMENTS

| | | | | |
|---|---|---|---|---|
| 839,556 | A | 12/1906 | Cuff | |
| 1,245,617 | A | 11/1917 | Prinzler | |
| 3,469,877 | A | 9/1969 | Hutchison | |
| 4,288,120 | A | 9/1981 | Moore | |
| 7,523,968 | B2 * | 4/2009 | Heid | E05B 15/0006 292/199 |

FOREIGN PATENT DOCUMENTS

| | | | | |
|---|---|---|---|---|
| EP | 1010844 | A1 | 6/2000 | |
| FR | 543914 | A | 9/1922 | |
| FR | 2400100 | * | 11/1977 | E05B 15/02 |
| FR | 2400100 | A1 | 3/1979 | |
| WO | 2007/006076 | A1 | 1/2007 | |

OTHER PUBLICATIONS

PCT, The International Bureau of WIPO, English translation of International Preliminary Report on Patentability and Written Opinion, International Application No. PCT/DE2019/100163, 10 pages (dated Sep. 3, 2020).
PCT, European Patent Office (ISA/EP), International Search Report, International Application No. PCT/DE2019/100163, 6 pages, dated May 28, 2019.

* cited by examiner

*Primary Examiner* — Kristina R Fulton
*Assistant Examiner* — Thomas L Neubauer
(74) *Attorney, Agent, or Firm* — Thompson Hine LLP

(57) ABSTRACT

In embodiments, a closure holder for a closure, in particular a door closure, includes a base element and an undercut arranged on the base element, which can be engaged from behind by a locking element of the closure in order to form a lock, and having an actuating device for adjusting the distance of the undercut relative to the base element.

19 Claims, 3 Drawing Sheets

CLOSURE HOLDER FOR A DOOR CLOSURE

TECHNICAL FIELD

The present disclosure relates to a closure holder for a closure, in particular a door closure, comprising a basic element and an undercut which is arranged on the basic element and can be engaged from behind by a bolt element of the closure in order to form a lock. The disclosure furthermore relates to a method for adjusting a closure holder for a closure, in particular a door closure, comprising a basic element and an undercut which is arranged on the basic element and can be engaged from behind by a bolt element of the closure in order to form a lock.

BACKGROUND

Closure holders are used in openings which are configured to be closable, such as doors, hatches and windows. Said openings there, as part of a closure, permit the locking of closing elements, such as, for example, door leaves, hatch covers, flaps, window casements/sashes or covers, to a frame surrounding the opening. A bolt element of the closure, such as a bolt, a casement/sash fastener or a lock latch, enters here into engagement with the closure holder in such a manner that said bolt element reaches behind an undercut of the closure holder. The closure holder and the bolt element thereby form a releasable lock.

For this purpose, the bolt element and the closure holder are arranged on the closing element or on the frame. Either the bolt element is arranged on the closing element and the closure holder on the frame or the closure holder is arranged on the closing element and the bolt element is arranged on the frame.

In order to release the closing element in order for the latter to be opened, the bolt element has to be released from the undercut. This is typically undertaken via a handle or a key mechanism which moves the bolt element away from the undercut by means of a rotational or longitudinal movement in such a manner that the undercut is no longer engaged from behind by the bolt element. The locking of the bolt element and of the closure holder is released. The closing element is unlocked from the frame and the opening can be opened up by the closing element.

So that the closing element which is locked to the frame uniformly closes the opening and at the same time also compresses sealing elements, such as sealing profiles or sealing beads, which are arranged between the frame and the closing element, for sealing purposes, the undercut usually has to be aligned in order to compensate for manufacturing tolerances, wear effects and similar that occur in practice. The aim of this alignment is to position the undercut in such a manner that the closing element locked by means of the bolt element and the closure holder is at a uniform distance from the frame and at the same time exerts a sufficient contact pressure on the sealing elements.

This alignment typically takes place during the installation by means of the arrangement of spacers, for example in the manner of shims or similar, between the frame or the closing element and a basic element of the closure holder, by means of which basic element the undercut is arranged on the frame or the closing element. However, this alignment has frequently proved to be highly complicated in practice since the basic element has to be released from the frame or the closing element in order to fit a spacer and has to be subsequently fastened again. The spacers permit an adaptation only in discrete steps which depend on the thickness of the available spacers, and therefore a uniform distance and contact pressure can be obtained only to a limited extent. In addition, retrospective adaptations of the alignment of the undercut, as are required, for example, due to wear effects, the use of other sealing elements or distortion of the frame and/or the closing element, are possible only to a limited extent and with a very high outlay. This is because in these cases too, the closure holder can be adjusted only by a complicated release of the connection to the frame or to the closing element.

SUMMARY

It is therefore the object of the present disclosure to specify a closure holder which permits a simpler and more precise alignment.

This object is achieved in the case of a closure holder of the type mentioned at the beginning by means of an actuating device for adjusting the distance of the undercut in relation to the basic body.

The actuating device makes it possible to adjust the distance of the undercut in relation to the basic element and therefore to the frame and/or to the closing element in a simple manner. The alignment of the undercut can take place continuously irrespective of the thickness of available spacers. The basic element does not need to be released from the frame or the closing element, but this is nevertheless also possible. A uniform distance of the closing element in the locked position from the frame and therefore a uniformly exerted contact pressure on the sealing elements can be achieved in a simple manner with a high degree of precision by adjustment of the distance of the undercut.

Parts of the actuating device for producing an actuating movement are preferably movable transversely with respect to the basic element. By means of a partial movement of the actuating device transversely with respect to the basic element, the distance of the undercut can be adjusted in a particularly advantageous manner.

It has proven advantageous if the actuating device is configured in such a manner that it can be used to adjust the contact pressure of a sealing element. The sealing element can be arranged between a closing element and a frame. The sealing element can be configured as an encircling door seal. The tightness of the closing element despite manufacturing tolerances occurring can be ensured by the adjustment of the contact pressure of the sealing element.

Furthermore, it has proved advantageous if the distance of the undercut is adjustable in order to realize different closing positions. The closing positions correspond to the position of the closing element in relation to the frame in the closed position. Each closing position can therefore correspond to a position of the closing element in relation to the frame. By means of the change in the closing position of the closing element, the contact pressure on a sealing element can therefore also be adjusted. The distance of the undercut and therefore also the contact pressure can be adjustable continuously. The adjustment direction of the distance of the undercut can correspond to the closing direction of the closing element. The closing direction is perpendicular to the closing element in the closed position. In each closing position, the distance between the closing element and the frame may be different. If the distance is reduced, the sealing element arranged between the closing element and the frame is compressed more strongly, and therefore the tightness is improved. The closing angle of the closing element can also be adjusted by changing the distance. The closing angle is smaller the closer the closing element lies against the frame in the closed position. If no sealing element is provided, the closing angle would therefore be 0 degrees when the closing element is closed.

The undercut is preferably arranged on a receiving element, wherein the receiving element and the undercut are jointly adjustable via the actuating device. The undercut can be arranged movably in a structurally favorable manner by means of the receiving element. The receiving element can enable an exchange of the undercut. The joint adjustability of the receiving element and of the undercut makes it possible to obtain a structurally simple, compact design.

Furthermore, a guide for guiding the actuating movements of the receiving element is advantageous. By means of a guide, the receiving element can be guided in a structurally simple manner. The play of the receiving element transversely with respect to the actuating movements of the actuating device can be reduced, in particular suppressed, by means of the guide.

The guide is preferably formed from a basic-element-side guide region and a receiving-element-side guide region, said guide regions lying against one another in the manner of a sliding guide. Surfaces of the two guide regions that lie against one another can make possible a guide which is form-fitting except for one axial degree of freedom. The guide regions can be formed in a complementary manner to one another. In a particularly advantageous manner, the guide regions can be formed in a form-fitting manner, in particular along a plurality of axes transversely with respect to the actuating direction of the actuating movements of the receiving element. Emergence of the receiving element from the guide can be avoided in a simple manner. Alternatively or additionally, the guide regions can also transmit closure forces which act on the closure holder and act on the closure holder from the outside, for example via the closing element or the bolt element. A loading of the actuating device with said closure forces, in particular transversely with respect to the direction of the actuating movement of the actuating device and/or of the receiving element, can be avoided and, by this means, the risk of damage to the actuating device can be reduced.

In this connection, it is particularly advantageous if the guide has a guide structure engaging in a complementary guide structure in order to linearly guide the receiving element. The guide structures can provide additional secure guidance in the manner of guide rails and/or guide grooves in a simple manner.

In a development of the disclosed closure holder, the basic element and the receiving element are formed in the manner of plug-in connecting elements. The formation in the manner of plug-in connecting elements can permit a simple and reliable connection of the basic element to the receiving element. The actuating movement can be guided in a structurally simple manner, by means of a complementary formation of regions of the plug-in connecting elements that lie against one another. The basic element can entirely or partially engage around, in particular opposite, sides of the receiving element or can be engaged around by the receiving element.

A pin of the basic element preferably engages in a plug-in element of the receiving element. By means of the engagement of the pin in the plug-in element, a plug-in connection which is secured against movements along a plurality of movement directions, in particular along all of the movement directions lying in a plane, can be obtained.

According to a structural refinement, it is proposed that the actuating device has an actuating element and/or a mating thread and/or a bearing opening. The actuating element can permit simple actuation of the actuating device in order to adjust the distance of the undercut in relation to the basic element. The mating thread can connect the actuating device to the basic element or to the receiving element. Alternatively or additionally, the actuating device can be connected to the receiving element or to the basic element via the bearing opening. The actuating element and/or the mating thread and/or the bearing opening can be designed to be releasable from one another in order to dismantle the actuating device. In order to adjust the distance, the actuating element and the mating thread and/or the bearing opening can interact in the manner of a rotor and stator system. The actuating device can be designed in particular in the manner of an elevating thread or a spindle drive.

Preferably, two actuating devices are provided and are arranged on either side of the undercut. Two actuating devices permit an oblique position in relation to the basic element. The undercut can be inclined in relation to the basic element by means of differently adjusted distances. The adjustable inclination of the undercut can be used to compensate for a distortion of the frame and/or of the closing element. An arrangement of the actuating devices on either side of the undercut permits the distance of the undercut from the basic element to be adjusted reliably and stably against unwanted movements. The two actuating devices can support the undercut in the manner of a two-point support along the actuating direction.

In a further refinement, the actuating element comprises a thread for connection to the mating thread arranged on the basic element and/or a groove for the rotatable, but axially fixed arrangement on the receiving element. The thread of the actuating element as an external thread can interact with the mating thread of the basic element, in the form of an internal thread, or as an internal thread can interact with the mating thread of the basic element, in the form of an external thread. The distance of the undercut from the basic element can be adjusted continuously via a relative rotation of the thread in relation to the mating thread. The rotational movement of the actuating element can be converted into a linear actuating movement of the receiving element. The actuating element can be formed helically with a head diametrically opposite the thread. The head preferably comprises a drive region, in particular in the form of a hexagon socket, hexagon stub, hexalobular socket, slot or cross slot, for driving the actuating element by means of a correspondingly designed drive device, such as a manual screwdriver or a drill screwdriver. The actuating element can be mounted on the receiving element in a freely rotatable manner in the circumferential direction by means of the groove. The groove is preferably arranged between the thread and the head of the actuating element. The groove can be designed in the manner of a circumferential groove with a smaller radial diameter than the thread and/or the head of the actuating element.

In a further embodiment of the closure holder, the receiving element comprises the bearing opening of the actuating device with a bearing region for transmitting push and pull forces and with a larger plug-in region for the plugging-in of the actuating element. The bearing region can have an inside diameter which is smaller than the outside diameter of the thread and/or of the head of the actuating element. Emergence of the closing element along the axial direction from the bearing region can therefore be prevented by means of a form fit. The bearing region can be designed in such a manner that it receives the actuating element, in particular a groove of the actuating element, in a substantially form-fitting manner. By means of a substantially form-fitting mounting of the actuating element, the latter can be fixed along its axial direction. Push and pull forces can be transmitted in a simple manner from the actuating element to the receiving element in order to adjust the distance from the basic element. The plug-in region can have an inside diameter which is greater than the outside diameter of the thread and/or of the head of the actuating element. The actuating element can be plugged with the smaller, thread-side and/or head-side end in front into the larger plug-in region of the bearing opening. By transfer of the actuating element from the plug-in region into the bearing region of the bearing opening, the actuating element and/or the receiving element can be moved substantially transversely with respect to the actuating direction. The actuating element can preferably be moved when the actuating element is not yet arranged on the basic element. The receiving element can preferably be moved when the actuating element is already arranged on the basic element. For the transfer from the bearing region into the plug-in region, the movement can take place in the reverse direction. The bearing region and the plug-in region can form two diametrically opposite ends of the bearing opening.

In a preferred development of the closure holder, the bearing region and the plug-in region form a keyhole-shaped bearing opening. A keyhole-shaped bearing opening, in which the bearing region and the plug-in region are substantially round and are connected to one another by means of an elongated hole, permits a structurally simple transfer of the actuating element between the plug-in region and the bearing region. Alternatively, the bearing region and the plug-in region can also form a bearing opening of a different geometrical shape, for example a triangular, trapezoidal, kite-shaped or L-shaped bearing opening, in particular with rounded corner regions. The bearing region and the plug-in region preferably have circular openings with different diameters. The openings of the bearing region and of the plug-in region may overlap. The opening of the plug-in region may be larger than the opening of the bearing region.

Preferably, the bearing regions of at least two bearing openings face one another. In the case of a closure holder having a plurality of actuating devices, the actuating elements thereof can be mutually secured against emerging from the bearing region by means of the arrangement of the bearing openings with bearing regions facing one another. In this case, the actuating elements, in order to be able to appear, would have to be transferred from the bearing region into the plug-in region. The mutually facing arrangement of the bearing regions means that the actuating elements would have to move here in opposite directions, which is not possible in particular with actuating elements arranged on the basic element. In addition, a movement of the receiving element transferring the actuating elements into the plug-in regions can also be prevented. This is because the receiving element would have to be moved simultaneously along two opposite directions.

In a method of the type mentioned at the beginning, it is proposed, in order to solve the object mentioned above, that the distance of the undercut in relation to the basic element is adjusted via an actuating device.

The advantages already explained in conjunction with the closure holder are afforded. By means of the actuating device, the distance of the undercut from the basic element and therefore from the frame and/or the closing element can be adjusted in a simple manner. The alignment of the closure holder can take place continuously irrespective of the thickness of the available spacers. The basic element does not need to be released from the frame and/or the closing element, but this is nevertheless also possible. A uniform distance of the closing element in the closed position from the frame and a uniformly exerted contact pressure on the sealing element can be obtained by adjustment of the distance of the undercut.

The features described in conjunction with the closure holder according to the invention can also be used individually or in combination in the method. The advantages described are afforded.

With regard to the method, it has proven advantageous if an actuating element is plugged into a plug-in region of a receiving element, and the receiving element and the actuating element are displaced in relation to each other transversely with respect to the plug-in direction in order for a groove to engage in a bearing region. The actuating element can be arranged fixed axially in a structurally simple and rapid manner on the receiving element in order to adjust the distance of the undercut. The actuating device can comprise the actuating element, the plug-in region and the bearing region.

Furthermore, a device is proposed with a closing element, in particular a door, a frame on which the closing element is mounted pivotably, and a closure holder for adjusting the closing position of the closing element, wherein the closure holder is configured in the manner described above. The position of the closing element in the closed position in relation to the frame can be secured via the closure holder. The device can comprise a sealing element which is arranged for sealing between the frame and the closing element in the closed position. The sealing element can prevent an exchange of gases between the interior, which is closeable with the closing element, and the exterior. The closing position of the closing element can be adjusted via the closure holder in such a manner that the sealing element is compressed to differing degrees. Furthermore, however, manufacturing tolerances can also be compensated for by the closure holder. The closure holder can be arranged on one side of the frame and the closing element can be mounted on the frame, on the opposite side thereof. All of the elements of the device can be configured in the manner as has already been described with respect to the closure holder.

Furthermore, an in particular pivotable bolt can be arranged on the closing element for locking the closing element in the closed position. The bolt can be in the form of a casement/sash fastener tongue. The bolt can engage in the undercut of the closure holder in order to lock the closing element in various closing positions.

It is furthermore advantageous if the device comprises a plurality of closure holders. The latter can be at least partially arranged around the circumference of the closing element. By means of a plurality of closure holders, a contact pressure of the sealing element that is constant over the extent of the closing element can be ensured. Deformations of the closing element, such as may occur, for example, if only one closure holder is used, can therefore be prevented.

BRIEF DESCRIPTION OF THE DRAWINGS

Further details and advantages of a closure holder according to the invention and of a method for adjusting the closure holder will be explained by way of example below using an exemplary embodiment of the invention that is illustrated schematically in the figures, in which.

DETAILED DESCRIPTION

Closure holders 1 are used for locking purposes, for example in the case of door closures. They have an undercut 4.2 which is engaged from behind by a bolt element, such as a bolt or a lock latch, a closure for locking a closing element, such as, for example, a door leaf, hatch cover, window casement/sash, cover or a flap, to a frame. For this purpose, the bolt element is typically arranged on the closing element and the closure holder 1 on the frame. Nevertheless, the closure holder 1 can also be arranged on the closing element and the bolt element on the frame. The bolt element and the undercut 4.2 form a lock here between frame and closing element. An opening which is surrounded by the frame and which can be, for example, a door, hatch or a window, can thus be locked in a simple manner.

In order to permit uniform closing of the opening by means of the closing element and also to compress, for sealing purposes, a sealing element, such as a sealing lip or sealing bead, which is arranged between the frame and the closing element, the closure holder 1 has to be aligned. The closure holder 1 according to the invention permits simple and precise alignment. According to the invention, the frame does not have to be a separate element. The frame can also be formed by the edge of a wall or similar surrounding the opening.

Figure 1:
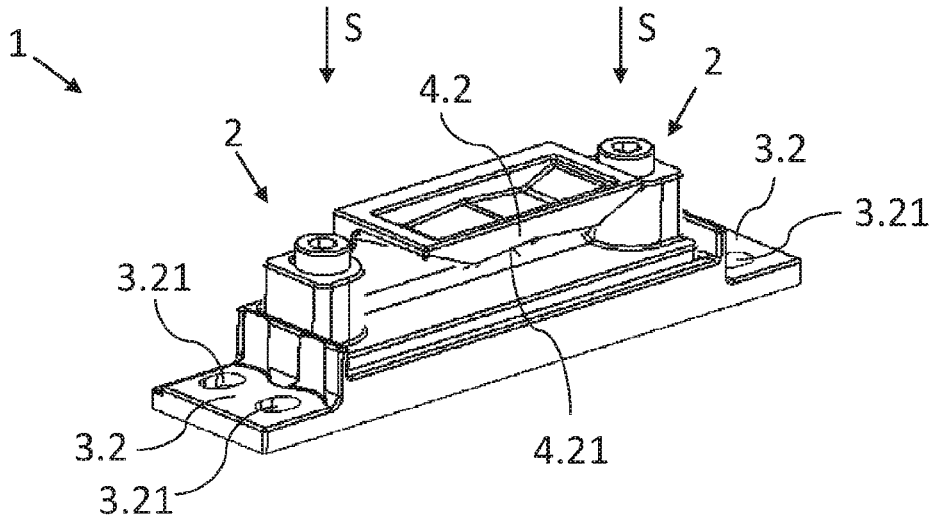
FIG. 1 shows a perspective view of a closure holder.
Figure 2:
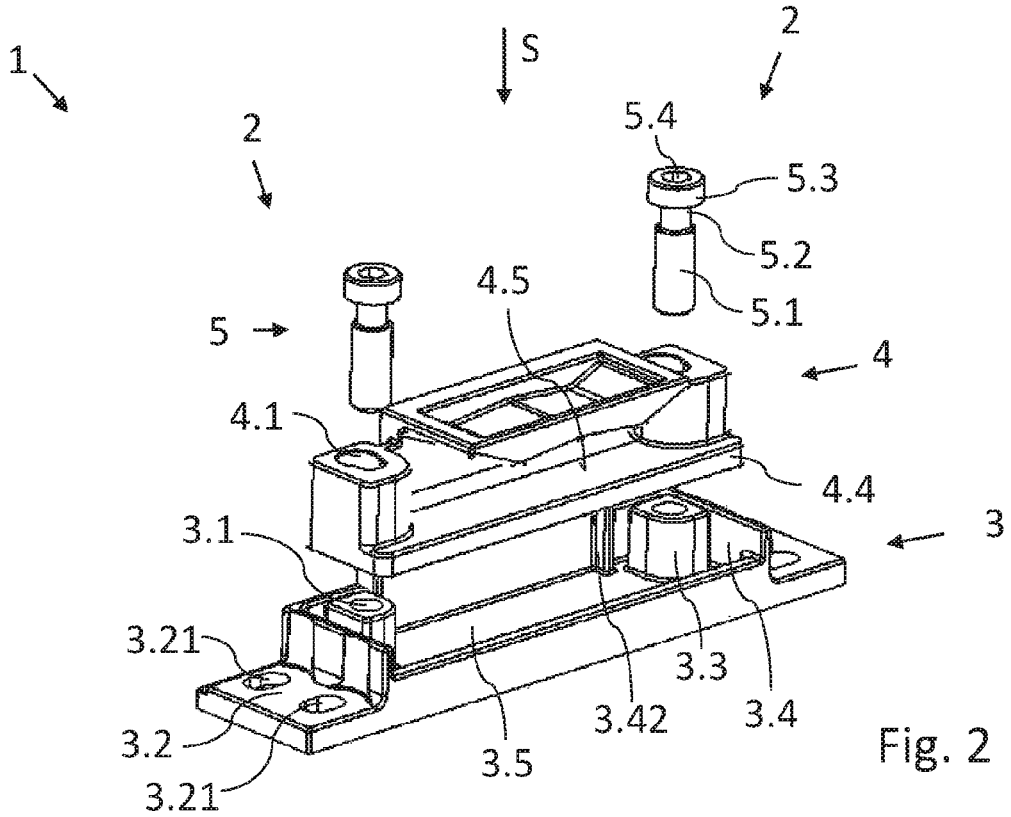
FIG. 2 shows an exploded illustration of the closure holder.

A mounted closure holder 1 is illustrated perspectively in FIG. 1. Said closure holder 1 is illustrated as an exploded illustration in FIG. 2, as a result of which the individual elements thereof can be seen better. The closure holder 1 has fastening regions 3.2 for fastening to or in a frame or a closing element. For the fastening, connecting means, not illustrated, such as, for example, screws or rivets, are plugged into fastening recesses 3.21 of the fastening regions 3.2 and connected to the frame, the closing element or an element arranged thereon.

As can be seen, the closure holder 1 essentially comprises four elements: a basic element 3, a receiving element 4 and two actuating elements 5. However, a single actuating element 5 would also be sufficient for the distance adjustment according to the invention. Furthermore, the closure holder 1 can also comprise further elements in addition to the element shown. The elongate basic element 3 and the receiving element 4 which is substantially in the shape of a C profile preferably consist of injection molded plastic, but may also have metal elements, in particular in the region of the undercut 4.2, or may be completely composed of metal.

The undercut 4.2 is arranged on the receiving element 4 and, in the mounted state, runs substantially parallel to the side 4.5 of the receiving element 4 lying opposite it along an actuating direction S which runs parallel to the actuating movement of the undercut 4.2. Together with the side 4.5, the undercut 4.2 surrounds a substantially empty space, in which the bolt element can engage for locking purposes. For this purpose, the bolt element engages the undercut 4.2 from behind, which prevents a movement of the bolt element, for releasing the opening, relative to the closure holder 1, in particular counter to the actuating direction S, until the lock is undone, for example by pivoting or pulling the bolt element away. The side 4.5 and the undercut 4.2 here form a region of the receiving element 4 with a C-shaped cross section. In order to be engaged from behind by the bolt element as securely as possible, that side 4.21 of the undercut which faces the bolt for locking purposes has a substantially W-shaped profile.

Each of the actuating elements 5 together with a mating thread 3.1 and a bearing opening 4.1 forms an actuating device 2 with which the distance of the undercut 4.2 in relation to the basic element 3 can be adjusted. However, for the adjustment according to the invention of the distance of the undercut 4.2, a single actuating device 2 would also be sufficient, with the closure element 1 then essentially consisting of three elements.

The actuating device 2 permits a movement of the undercut 4.2 in relation to the basic element 3 along the actuating direction S in the manner of a spindle drive by said actuating device moving the receiving element 4, which carries the undercut 4.2 and is adjustable together therewith, along the actuating direction S optionally toward the basic element 3 or away from the basic element 3. For this purpose, the actuating device 2 has a bearing opening 4.1 which is arranged on the receiving element 4 and is formed in particular integrally with the receiving element 4. The actuating element 5 is mounted on one side in the bearing opening 4.1. At its opposite end, the actuating element 5 interacts with the mating thread 3.1, which is fastened to the basic element 3. In order to change the distance between the basic element 3 and the undercut 4.2, the actuating element 5 is rotated about its longitudinal axis. This rotational movement is converted into a linear movement of the actuating element 5 by the interaction of the actuating element 5 with the mating thread 3.1. By means of this linear movement, the actuating element 5 together with the receiving element 4, which carries the actuating element 5 in a manner rotating freely in the bearing opening 4.1, is pulled toward the basic element 3 or pushed away from the latter depending on the direction of rotation. The distance is therefore adjusted in the manner of an elevating thread or a spindle drive, which is mounted on one side in the receiving element 4, with the basic element 3 as the spindle nut.

Nevertheless, in the case of an actuating device 2 according to the invention, the bearing opening 4.1 can also be arranged on the basic element 3 and the mating thread 3.1 on the receiving element 4. It is also possible, in the case of an actuating device 2 according to the invention, for individual or a plurality of parts of the above-described actuating device 2 to be omitted.

As can be seen in FIG. 1, the cylindrical actuating element 5 has a thread 5.1 which serves for connecting the actuating element 5 to the basic element 3. On the side lying diametrically opposite the thread 5.1, the actuating element 5 has a head 5.3 which forms the end of the actuating element 5. The head 5.3 has a larger radius than the thread 5.1 but can also be formed with the same radius as the thread 5.1. In addition, the head 5.3 comprises a drive region 5.4 which is designed in the manner of a hexagon socket. Alternatively, the drive region 5.4 can be designed in the form of a hexagon stub, hexalobular socket, slot or cross slot. The actuating element 5 is coupled via said drive region 5.4 to a drive device, not illustrated, such as, for example, a screwdriver or drill screwdriver, for driving the actuating movement. The actuating element 5 has overall a substantially screw-like geometry.

For the arrangement on the receiving element 4, the actuating element 5 has a circumferential tapering with a groove 5.2. The groove 5.2 is bounded by the thread 5.1 and the head 5.3, but can nevertheless also be at a distance from said thread and head. The groove 5.2 permits a rotational, but axially fixed arrangement on the receiving element 4. For this purpose, the groove 5.2 is configured in the manner of a radius change abruptly springing back inward. This permits a form-fitting mounting of the groove 5.2 in the bearing opening 4.1. Push and pull forces can be transmitted from the actuating element 5 to the receiving element 4 in order to adjust the distance in relation to the basic element 3.

Figure 3:
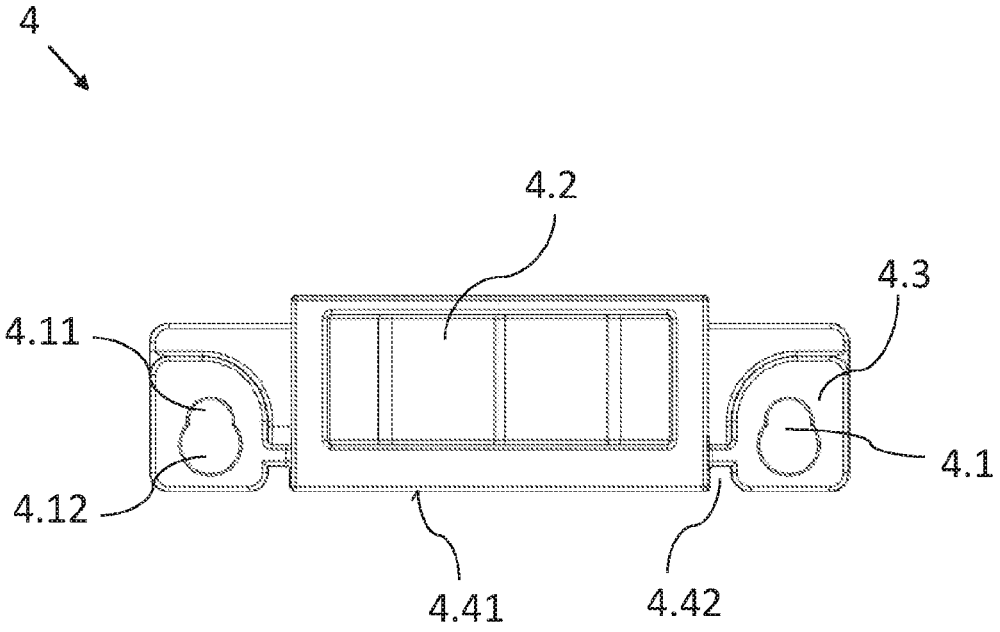
FIG. 3 shows a top view of a receiving element.

FIG. 3 illustrates the receiving element 4 according to FIG. 1 in more detail. The bearing openings 4.1 are arranged on both sides of the undercut 4.2. By this means, the actuating devices 2 are arranged on either side of the undercut 4.2. In addition to the adjustment of the distance of the undercut 4.2 in relation to the basic element 3, the two actuating devices 2 also permit an inclination of the undercut 4.2. By means of the adjustable oblique position of the undercut 4.2, a distortion of the closing element and/or of the frame caused by manufacturing tolerances or caused by wear can be compensated for. Different distances between the undercut 4.2 and the basic element 3 can be set by means of the actuating devices 2, thus resulting in an inclination of the undercut 4.2 in relation to the basic element 3.

As described above, the actuating element 5 of the actuating device 2 is mounted on a bearing opening 4.1 of the receiving element 4, said bearing opening likewise belonging to the actuating device 2. The bearing opening 4.1 has a bearing region 4.11 and a plug-in region 4.12. The plug-in region 4.12 is larger than the bearing region 4.11. This makes it possible to plug the actuating element 5, with the thread 5.1 and/or the head 5.3 in front, into the plug-in region 4.12. For this purpose, the inner radius of the plug-in region 4.12 is at least the same size as the outside diameter of the thread 5.1 and/or of the head 5.3 of the actuating element 5.

By contrast, the bearing region 4.11 has an inside diameter below the outside diameter of the thread 5.1 and/or of the head 5.3 of the actuating element 5. This smaller inside diameter of the bearing region 4.11 prevents an actuating element 5 which is mounted in the bearing region 4.11 from being able to emerge from the bearing region 4.11 in the axial direction. An axial restriction of the movement freedom of the actuating element 5 is achieved. The radius of the bearing region 4.11 substantially corresponds to the outside diameter of the groove 5.2 of the actuating element 5. The axial dimension of the bearing region 4.11 likewise substantially corresponds to the axial length of the groove 5.2. The groove 5.2 can thereby be mounted in a form-fitting manner in the bearing region 4.11. The push and pull forces are thus transmitted from the actuating element 5 to the receiving element 4 in order to adjust the distance in relation to the basic element 3.

The bearing region 4.11 and the plug-in region 4.12 form a keyhole-shaped bearing opening 4.1 in which the two substantially circular regions 4.11 and 4.12 are connected to each other via an elongated hole running between the two regions 4.11, 4.12. The smaller diameter of said elongated hole substantially corresponds here to the inside diameter of the bearing region 4.11.

Figure 4:
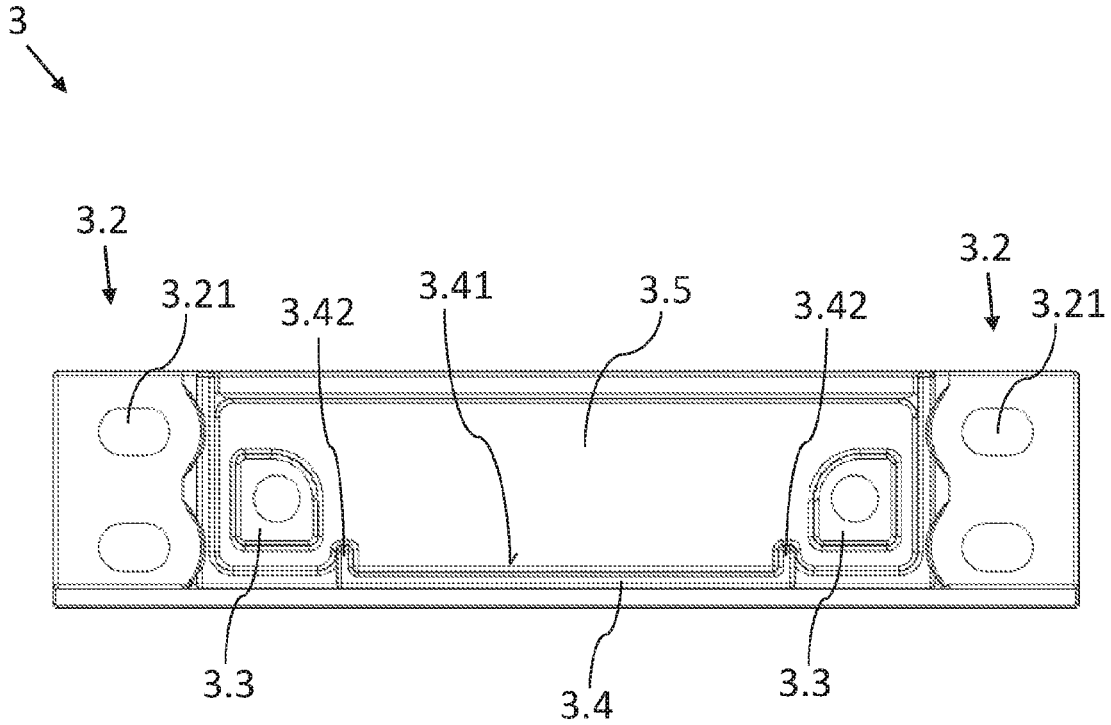
FIG. 4 shows a top view of a basic element.

The basic element 3 illustrated in FIG. 1 will be described in more detail below with reference to the illustration in FIG. 4. It has a bar-shaped geometry of substantially lower height than length.

Along its longitudinal axis, the center of the basic element 3 has an insertion region 3.5, into which the receiving element 4 is inserted for the mounting of the closure holder 1. The insertion region 3.5 is surrounded by a frame-like guide region 3.4 for guiding the actuating movement of the receiving element 4. Said guide region 3.4 interacts with a circumferential guide region 4.4 of the receiving element 4 illustrated in FIG. 3. The two guide regions 3.4, 4.4 together form a guide for guiding the actuating movement of the receiving element 4. For this purpose, they lie against one another with the contact surfaces 3.41, 4.41 in the manner of a sliding guide. The guide region 3.4 is formed in a complementary manner to the guide region 4.4 and receives the latter, which permits a form-fitting guidance of the movement of the receiving element 4. Closure forces acting transversely with respect to the actuating device 2 are transmitted from the receiving element 4 to the basic element 3 by means of the guide 3.4, 4.4. A disadvantageous action, in terms of the connection, upon the actuating device 2 and the actuating element 5 with said closure forces is prevented. The actuating devices 2 and in particular the actuating elements 5 lie to this extent outside the force flux.

The guide region 4.4 and the bearing opening 4.1 are arranged with respect to each other in such a manner that, with the closure holder 1 fitted, with the guide region 4.4 lying against the guide region 3.4, the actuating element 5 which is secured via the mating thread 3.1 cannot be transferred from the bearing region 4.11 into the plug-in region 4.12. In the mounted state, an unintentional emerging of the actuating element 5 from the bearing opening 4.1 and therefore dismantling of the actuating device 2, and release of the receiving element 4 from the basic element 3, are prevented.

In order to securely guide the receiving element 4, the basic element 3 furthermore has two rail-shaped guide structures 3.42. The latter are formed integrally with the guide region 3.4, wherein, according to the invention, the guide structures 3.42 can also be separate elements spaced apart from the guide region 3.4 and in particular a single guide structure 3.42. The guide structures 3.42 arranged in the manner of tracks engage in groove-shaped guide structures 4.42, formed in a complementary manner thereto, of the receiving element 4. By means of the engagement in the guide structures 4.42, the guide structures 3.42 lying next to one another on the same side of the basic element 3 permit secure guidance of the actuating movement in the manner of guide rails and guide grooves.

The basic element 3 and the receiving element 4 are formed in the manner of interacting plug-in connection elements by means of the guide 3.4, 4.4. The basic element 3 partially surrounds the receiving element 4 by means of the guide region 3.4 along the section plane illustrated in FIG. 5.

Two pins 3.3 protrude from that side of the basic element 3 which faces the receiving element 4. Said pins each bear a mating thread 3.1, which, as part of the actuating device 2, interacts with the thread 5.1 of the actuating element 5 for the connection of the latter. The mating thread 3.1 is in the form of an internal thread of a threaded bore. In order to connect the basic element 3 to the receiving element 4, the pins 3.3 are plugged into plug-in elements 4.3 of the receiving element 4. The plug-in elements 4.3 each bear the bearing openings 4.1 of the actuating devices 2. In particular in the case of a closure holder 1 according to the invention with just one actuating device 2, it is optionally possible also only to provide in each case one pin 3.3 and one plug-in element 4.3. The circumferential inner surface of the plug-in element 4.3 and the circumferential outer surface of the pin 3.3 additionally guide the actuating movement of the undercut 4.2. In addition, when a pin 3.3 is plugged into the plug-in element 4.3, the mating thread 3.1 and the bearing region 4.11 of the bearing opening 4.1 are aligned with one another.

During the installation of the closure holder 1 and for the assembly of the actuating device 2, the actuating element 5 is first of all plugged into the plug-in region 4.12 of the receiving element 4 and displaced transversely with respect to the plug-in direction for the engagement of the groove 5.2 in the bearing region 4.11. The actuating element 5 which is mounted in the receiving element 4 is subsequently connected to the basic element 3 by means of the thread 5.1 and the mating thread 3.1. The receiving element 4 is inserted here or subsequently into the insertion region 3.5, with the guide regions 3.4, 4.4 and the guide structures 3.42, 4.42 engaging in one another in the manner of a plug-in connection. Alternatively, first of all an engagement of the thread 5.1 and of the mating thread 3.1 is produced and the receiving element 4 is subsequently plugged onto the actuating element 5 in such a manner that the actuating element 5 is plugged into the plug-in region 4.12. Subsequent thereto, the receiving element 4 is displaced in relation to the actuating element 5 and the basic element 3 in order to transfer the actuating element 5 into the bearing region 4.11. The second alternative requires the receiving element 4 to be spaced apart in relation to the basic element 3 via the actuating device 2 in such a manner that the guide regions 3.4, 4.4 do not lie against one another and the guide structures 3.42, 4.42 do not engage in one another.

Figure 5:
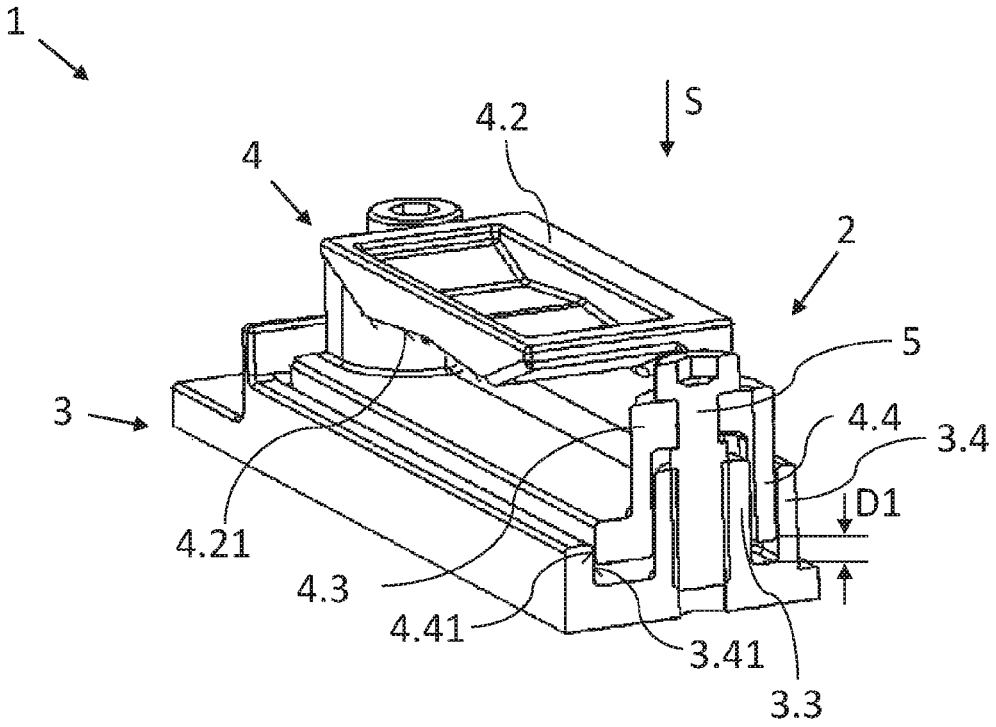
FIG. 5 and FIG. 6 show sectional views of the closure holder for comparing differently adjusted distances.
Figure 6:
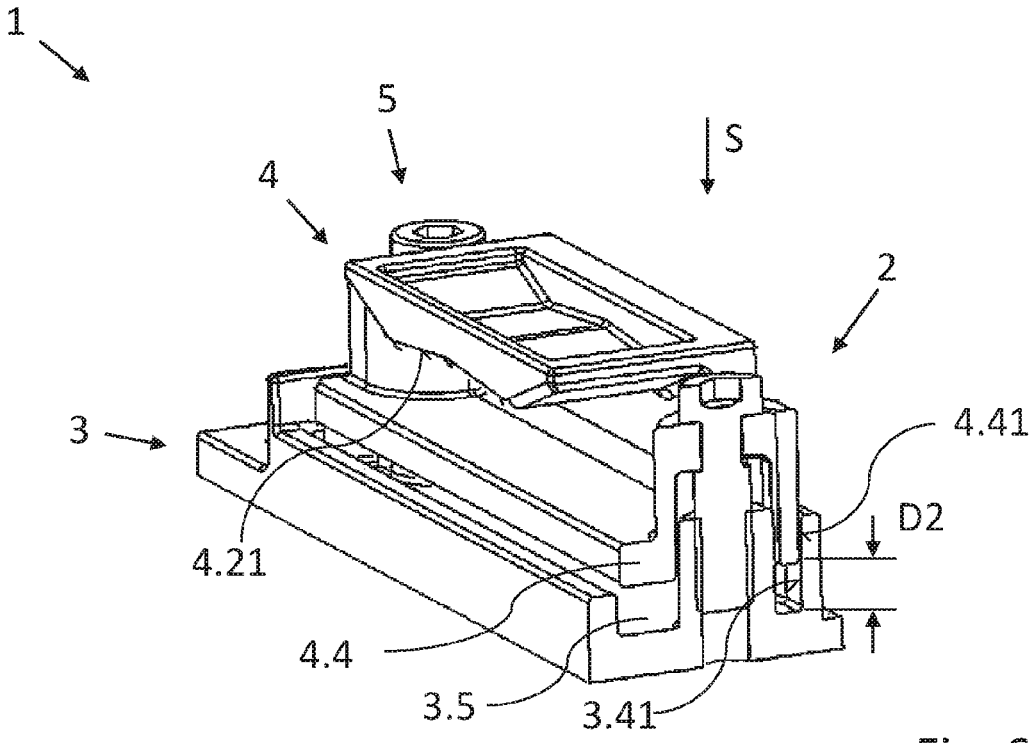

FIG. 5 and FIG. 6 show sectional views of the closure holder 1 according to FIG. 1 for differently adjusted distances of the undercut 4.2 with respect to the basic element 3. In FIG. 5, there is a smaller distance D1 between the basic element 3 and the receiving element 4. The guide regions 3.4 and 4.4 lie against one another with their contact surfaces 3.41, 4.41. The pin 3.3 engages in the plug-in element 4.3. Closure forces acting transversely with respect to the axis of the actuating element 5 can be transmitted by the receiving element 4 to the basic element 3 without having an effect on the actuating element 5.

In order to change the distance D1 and therefore also to adjust the distance of the receiving element 4 in relation to the basic element 3, the actuating element 5 is rotated about its longitudinal axis in order to actuate the actuating device 2. By means of the interaction of the thread 5.1 and the mating thread 3.1, said rotational movement is converted into an axial longitudinal movement of the actuating element 5. A push or pull force exerted by the axial longitudinal movement is transmitted to the receiving element 4 by the above-described axial fixing of the actuating element 5. The receiving element 4 is moved away from the basic element 3 or toward the latter by means of the push or pull force and is guided here by the guide 3.4, 4.4. Said guide is additionally supported by the guide structures 3.42, 4.42 which are not illustrated in FIG. 5 and FIG. 6.

In order to increase the distance D1 toward a distance D2, the actuating element 5 is rotated about its longitudinal axis, for example, counterclockwise. By this means, the actuating element 5 is unscrewed from the mating thread 3.1, which leads to a linear movement of the actuating element 5 together with the receiving element 4 and the undercut 4.2 counter to the actuating direction S. The actuating element 5 is rotated here until the greater distance D2 has been set.

The use of the above-described closure holder 1 and of the method for adjustments of the closure holder 1 makes it possible to achieve a simpler and more precise alignment.

REFERENCE SIGNS

1 Closure holder
2 Actuating device
3 Basic element
3.1 Mating thread
3.2 Fastening region
3.21 Fastening recess
3.3 Pin
3.4 Guide region
3.41 Contact surface
3.42 Guide structure
3.5 Insertion region
Receiving element
4.1 Bearing opening
4.11 Bearing region
4.12 Plug-in region
4.2 Undercut
4.21 Side
4.3 Plug-in element
4.4 Guide region
4.41 Contact surface
4.42 Guide structure
4.5 Side
Actuating element
5.1 Thread
5.2 Groove
5.3 Head
5.4 Drive region

The invention claimed is:

1. A closure holder for a closure having a basic element and an undercut that is configured to permit the closure holder to be engaged from behind by a bolt element of the closure to form a lock, the closure holder comprising:

an actuating device that adjusts a distance of the undercut in relation to the basic element, wherein the actuating device has a bearing opening; and a receiving element having the undercut, wherein the receiving element includes the bearing opening of the actuating device, the bearing opening having a bearing region that transmits push and pull forces exerted by the closure and a plug-in region, larger than the bearing opening, that receives the actuating device.

2. The closure holder as claimed in claim 1, wherein the actuating device is configured such that it adjusts a contact pressure of a sealing element.

3. The closure holder of claim 1, wherein the distance of the undercut is adjustable to realize different closing positions.

4. The closure holder of claim 1, wherein the receiving element and the undercut are jointly adjustable via the actuating device.

5. The closure holder of claim 4, wherein the basic element and the receiving element are plug-in connecting elements.

6. The closure holder of claim 5, wherein the basic element includes a pin, the receiving element includes a plug-in element, and the pin engages the plug-in element.

7. The closure holder of claim 1, further comprising a guide that guides actuating movement of the receiving element.

8. The closure holder of claim 7, wherein the guide is formed from a basic-element-side guide region and a receiving-element-side guide region, wherein the basic-element-side guide region and the receiving-element-side guide region lie against one another to form a sliding guide.

9. The closure holder of claim 7, wherein the guide includes a guide structure and a complementary guide structure, and the guide structure engages the complementary guide structure to linearly guide the receiving element relative to the basic element.

10. The closure holder of claim 1, wherein the actuating device includes an actuating element and/or a mating thread.

11. The closure holder of claim 10, wherein the actuating element includes a thread for connection to the mating thread arranged on the basic element and/or a groove for the rotatable but axially fixed arrangement on the receiving element.

12. The closure holder as claimed in claim 10, wherein the receiving element includes the bearing opening of the actuating device having a bearing region for transmitting push and pull forces and with a larger plug-in region for the plugging-in of the actuating element.

13. The closure holder as claimed in claim 12, wherein the bearing region and the plug-in region form a keyhole-shaped bearing opening.

14. The closure holder as claimed in claim 12, wherein the bearing regions of at least two bearing openings face one another.

15. The closure holder of claim 1, further comprising two actuating devices arranged on either side of the undercut.

16. A method for adjusting a closure holder for a closure having a basic element and an undercut that is configured to permit the closure holder to be engaged from behind by a bolt element of the closure in order to form a lock, the method comprising:

selecting a receiving element having the undercut and having a bearing opening of an actuating device, the bearing opening having a bearing region that transmits push and pull forces exerted by the closure and a plug-in region, larger than the bearing opening; and adjusting via the actuating device a distance of the undercut in relation to the basic element, wherein the actuating device is received in the plug-in region.

17. The method as claimed in claim 16, further comprising plugging an actuating element into the plug-in region of the receiving element, and displacing the receiving element and the actuating element in relation to each other transversely with respect to the plug-in direction in order for a groove to engage in the bearing region.

18. A device comprising a closing element, a frame on which the closing element is mounted pivotably, and a closure holder, the closure holder comprising:

a basic element and an undercut that is configured to permit the closure holder to be engaged from behind by a bolt element of the closure to form a lock;

an actuating device that adjusts a distance of the undercut in relation to the basic element, wherein the actuating device has a bearing opening; and a receiving element having the undercut, wherein the receiving element includes the bearing opening of the actuating device, the bearing opening having a bearing region that transmits push and pull forces exerted by the closure and a plug-in region, larger than the bearing opening, that receives the actuating device.

19. A closure holder for a closure having a basic element and an undercut that is arranged on the basic element and is configured to be engaged from behind by a bolt element of the closure to form a lock, the closure holder comprising:

an actuating device that adjusts a distance of the undercut in relation to the basic element;

a receiving element, wherein the undercut is arranged on the receiving element, and the receiving element and the undercut are jointly adjustable via the actuating device; and wherein the basic element and the receiving element are plug-in connecting elements, and the basic element includes a pin, the receiving element includes a plug-in element, and the pin engages the plug-in element.

* * * * *